US005471961A

United States Patent [19]

McArthur et al.

[11] Patent Number: 5,471,961

[45] Date of Patent: * Dec. 5, 1995

[54] ELECTRICAL CIRCUITRY OF A FUEL RAIL ASSEMBLY

[75] Inventors: Robert A. McArthur, Waterford; Paul D. Daly, Troy, both of Mich.

[73] Assignee: Siemens Automotive L.P., Auburn Hills, Mich.

[ * ] Notice: The portion of the term of this patent subsequent to Jan. 12, 2010, has been disclaimed.

[21] Appl. No.: 116,236

[22] Filed: Sep. 2, 1993

[51] Int. Cl.[6] ..... F02M 39/00

[52] U.S. Cl. ..... 123/456; 123/470; 439/130

[58] Field of Search ..... 123/456, 468, 123/469, 470; 439/76, 79, 80, 130

[56] References Cited

U.S. PATENT DOCUMENTS

| | | | |
|---|---|---|---|
| 5,086,743 | 2/1992 | Hickey | 123/456 |
| 5,127,382 | 7/1992 | Imoehl | 123/456 |
| 5,131,857 | 7/1992 | Gmelin | 123/456 |
| 5,178,114 | 1/1993 | McArthur | 123/456 |
| 5,178,115 | 1/1993 | Daly | 123/456 |
| 5,189,782 | 3/1993 | Hickey | 123/456 |
| 5,226,391 | 7/1993 | Gras | 123/456 |
| 5,308,038 | 5/1994 | McArthur | 123/456 |

*Primary Examiner*—Carl S. Miller
*Attorney, Agent, or Firm*—Russel C. Wells

[57] ABSTRACT

Several embodiments for establishing electrical connection of individual fuel injectors on the interior of a fuel rail assembly to an electrical connector at the exterior of the fuel rail assembly include the use of flexible circuits and electronic circuit board assemblies.

9 Claims, 4 Drawing Sheets

ELECTRICAL CIRCUITRY OF A FUEL RAIL ASSEMBLY

FIELD OF THE INVENTION

This invention relates to electrical coupling of fuel injectors of a fuel rail assembly to an external electrical connector of the fuel rail assembly.

BACKGROUND AND SUMMARY OF THE INVENTION

Commonly assigned U.S. Pat. No. 5,178,114 and 5,178,115 disclose fuel rail assemblies having electrical circuitry. Modifications of the fuel injectors that are illustrated in those two patents are described in detail in U.S. Pat. No. 5,226,628. The present invention relates to improvements in the electrical circuitry of fuel rails like those disclosed in U.S. Pat. Nos. 5,178,114 and 5,178,115.

Several embodiments are disclosed herein. They have various electrical circuit arrangements that are intended to improve the fuel rail assembly in one or more of the following aspects: lower cost, easier fabrication and/or assembly, greater flexibility, technical improvement.

These several embodiments will be described in detail with reference to the accompanying drawings which include a presently preferred embodiment.

DESCRIPTION OF THE PREFERRED EMBODIMENT

Figure 1:
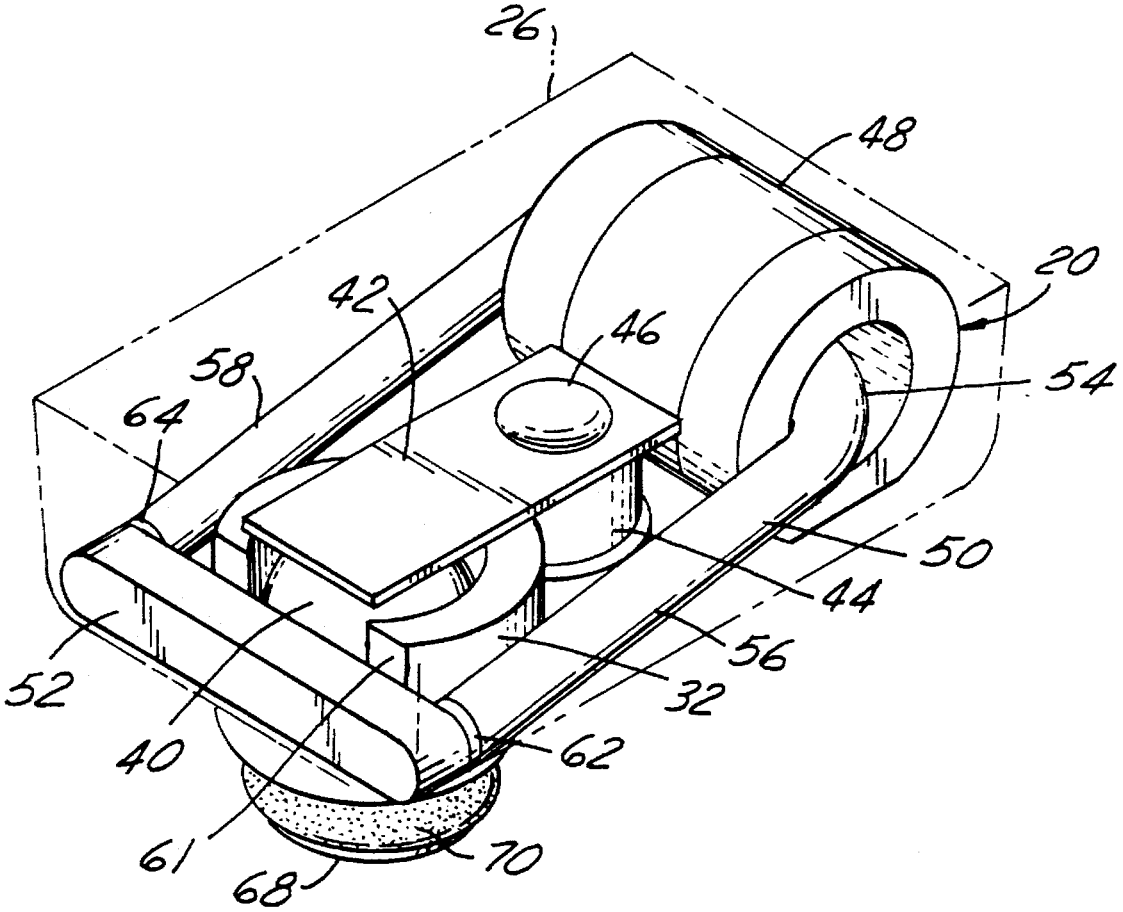
FIG. 1 is a perspective view of a fuel injector.

A fuel injector 20 that is well suited for use in a fuel rail assembly of the present invention is shown in FIG. 1. It will now be described briefly although a detailed description appears in U.S. Pat. No. 5,178,114.

In each of the fuel rail assemblies of FIGS. 2–7, there are three fuel injectors 20 disposed on a carrier assembly 22 that is disposed within a circular cylindrical walled fuel tube 24.

For each injector 20, carrier assembly 22 comprises a somewhat rectangular-shaped well 26 which has a sidewall and a bottom wall. Each injector comprises a seat member 32 that has a frustoconical seat that funnels to an outlet hole. The seat and outlet hole share a co-axis which is perpendicular to the bottom wall of well 26, and the bottom wall has a suitably-shaped hole allowing seat member 32 to fit therein. A sphere 40 is seated on the seat, and is shown concentric with the co-axis in closure of the outlet hole in the seat member. The sphere is resiliently urged to such concentricity by an overlying flat spring blade 42 which is cantilever-mounted atop an upright post 44 on the bottom wall of well 26 along side seat member 32. A head 46 of a fastener inserted into the top of the post overlaps the margin of the hole in the blade to hold the corresponding end of the blade securely on the top of post 44. Although the blade is flat and essentially parallel with the bottom wall of the well, the spring exerts a preload force on sphere 40 when the sphere is concentric with the co-axis.

The injector has a magnetic circuit that encircles sphere 40 and is composed of a solenoid coil 48, a stator 50, and an armature 52. The magnetic circuit may be considered to have a generally four-sided rectangular shape for fitting into well 26. Coil 48 and armature 52 form two opposite sides while the remaining two sides, which are opposite each other, are formed by portions of stator 50. Coil 48 is disposed in well 26 with its axis parallel to the bottom wall of the well and spaced from the coaxis of the seat and outlet hole in member 32. Stator 50 is generally U-shaped, comprising a base 54 that passes through coil 48 and parallel legs 56, 58 that extend from base 54 to form two opposite sides of the magnetic circuit. Armature 52 is in the form of a bar that is disposed along side sphere 40 and operated by the magnetic circuit to act on the sphere at essentially the midpoint of the bar. Seat member 32 contains a suitably shaped notch 61 that allows the armature to act on the sphere. In the condition portrayed in FIG. 1, which is for the solenoid coil not energized, the opposite ends of the bar are spaced from the distal ends of legs 56, 58 by generally equal working gaps 62, 64, and the midpoint of the armature is in contact with the sphere at the end of a particular radial of the sphere. When the solenoid coil is energized, the magnetic flux that is generated in the magnetic circuit operates to reduce working gaps 62, 64 by attracting armature 52 toward the ends of the stator's legs 56, 58. This causes armature 52 to be moved bodily predominantly along the direction of an imaginary line that intersects the co-axis and that when viewed along the co-axis is essentially coincident with the radius of the sphere whose end is contacted by the midpoint of the armature. The cooperative effect of the motion of armature 52, of the resilience of spring blade 42, and of the angle of the seat in member 32 is such that the sphere is moved from concentricity with the co-axis of the seat and outlet hole to eccentricity therewith and the resultant opening of the outlet hole in the seat member. Sphere 40 is actually caused to roll slightly up the seat in the direction toward post 44. When energization of the solenoid coil terminates, the magnetic attractive force that stator 50 had been exerting on the armature ceases, and this enables the resiliency of spring blade 42 to return the sphere to concentricity with the co-axis of the seat and outlet hole and resulting closure of the outlet hole.

The outlet hole is surrounded by the tip end, or nozzle, 68 of the fuel injector at which fuel is injected into the engine. An O-ring seal 70 is seated in a groove extending around the sidewall of the injector tip end. Metering of injected fuel can be performed by a thin orifice disc (not shown) mounted on the injector tip end in covering relation of the outlet hole.

Figure 4:
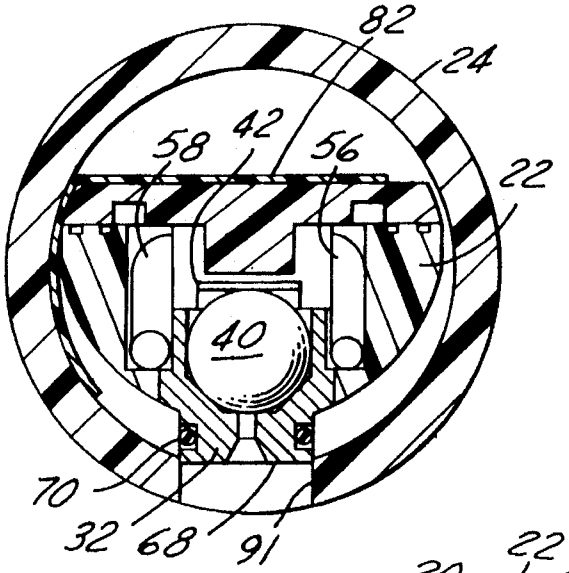
FIG. 4 is a transverse cross section view through the fuel rail assembly of FIG. 2 illustrating an alternate step.
Figure 3:
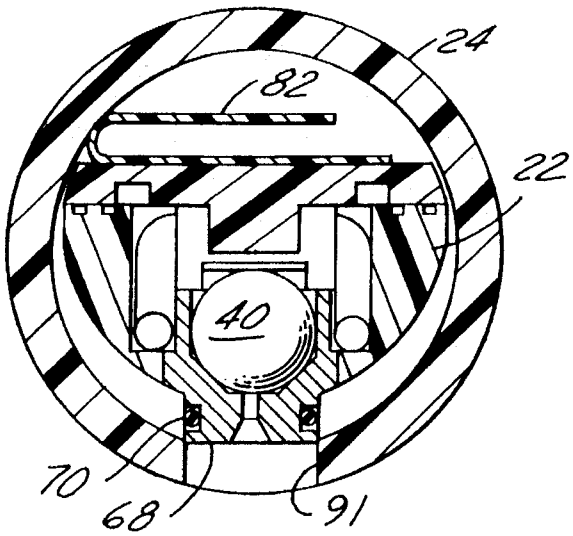
FIG. 3 is a transverse cross section view through the fuel rail assembly of FIG. 2 illustrating one step in a process of fabricating the assembly.
Figure 2:
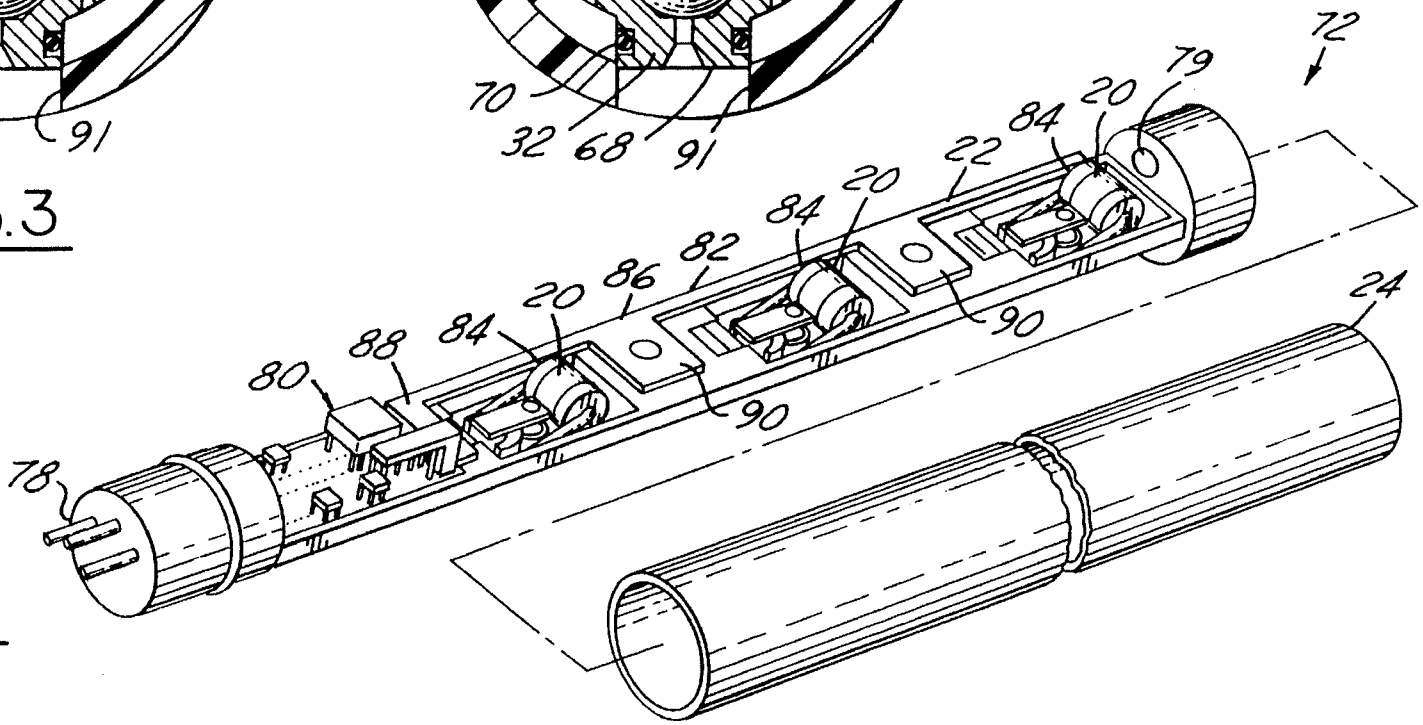
FIG. 2 is a perspective view, partly exploded, of a first embodiment of fuel rail assembly.

An exemplary fuel rail assembly 72 in FIGS. 2–4 comprises a carrier assembly 22 assembled into a fuel tube 24 in the manner described in U.S. Pat. No. 5,178,115. The carrier assembly has an electrical connector 78 at one end that also serves to close the corresponding open end of tube 24. A fuel inlet 79 may be in the closure at the opposite end. When a mating connector (not shown) is connected with connector 78, terminals of connector 78 are connected to a source of electrical signals for operating the fuel injectors. Internally of the fuel rail assembly the terminals of connector 78 are connected with electronic circuitry, 80 generally, and it in turn is connected with the individual fuel injectors. The electronic circuitry comprises solenoid driver circuits for driving the solenoids of the fuel injectors in accordance with signals from the remote source.

The coupling of circuitry 80 with the fuel injector solenoids is by means of a flexible circuit 82 that contains a number of individual electrical conductors. Each solenoid 48 has a pair of wires coming from it, and they are connected to respective conductors of flexible circuit 82. Such connections are made in the vicinity of the reference numerals 84 in FIG. 2. Flexible circuit 82 is nominally flat and comprises a number of individual electrically conductive paths that are sandwiched between nonconductor layers. It may be considered to comprise a trunk 86 that extends parallel to the length of the carrier assembly and tube and several branches that come off the trunk at right angles. There is a short branch at each set of connections 84, and a longer branch 88 where the flexible circuit 82 connects to electronic circuitry 80. The flexible circuit also has several tabs 90 of nonconductive material that provide a means for securing the flexible circuit on the carrier assembly. For example, the tabs 90 may be riveted to the carrier assembly.

In the views of FIGS. 3 and 4 one can see that the flexible circuit has been folded about a line that is parallel to the length of the fuel tube and carrier assembly in order for the carrier assembly, including the flexible circuit, to be inserted into the open end of fuel tube 24. In one case (FIG. 4) the outer margin of the flexible circuit that would, in the absence of such folding, extend into interference with the fuel tube preventing insertion of the carrier assembly therein, has been folded back around the portion of the carrier assembly that is toward the semi-circumference of the fuel tube that contains the row of holes 91 receiving the fuel injectors' nozzles when the carrier assembly is in final assembly position in the fuel tube. In the other case (FIG. 3) it has been folded in the opposite sense so as to lie between the carrier assembly and the semi-circumference of tube 24 that is opposite the semi-circumference that contains the row of through-holes 91. FIGS. 3 and 4 show a condition prior to final assembly position where the fuel injector nozzles are in the process of being seated in the through-holes 91. The termination of flexible circuit 82 at branch 88 that connects to electronic circuitry 80 may comprise a connector (not shown) for separable connection with a mating connector (also not shown), such as an edge connector on the board containing the electronic circuitry.

Figure 5:
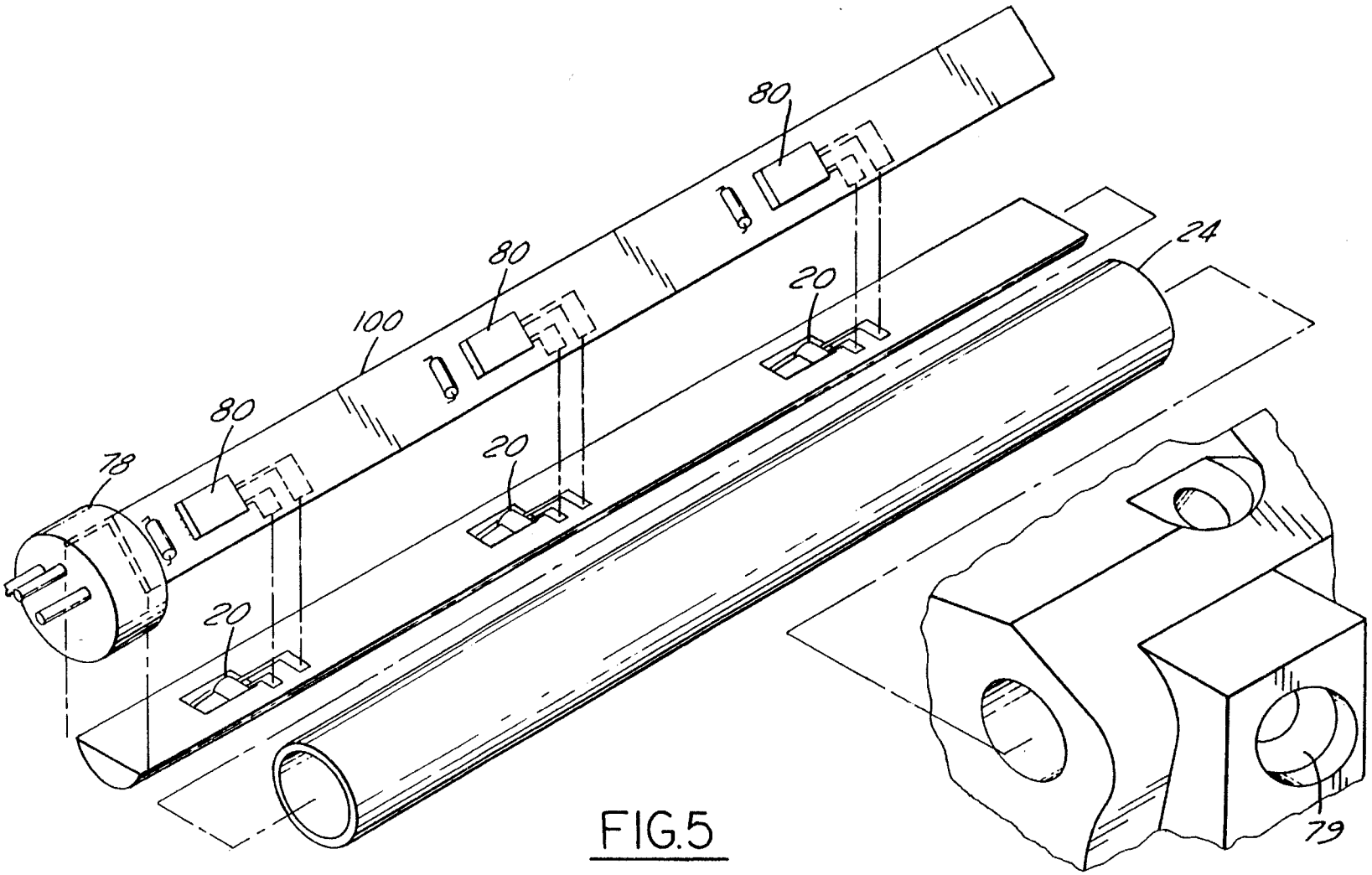
FIG. 5 is a perspective view, partly exploded, of a second embodiment of fuel rail assembly.

The fuel rail assembly of FIG. 5 comprises a keeper 100 that is inserted into the fuel tube after the carrier assembly has been inserted and the injector nozzles fully seated in through-holes 91. This keeper contains the connector 78 that closes the one end of the tube. The electronic circuitry 80 is mounted on the keeper. This embodiment has the flexible circuit 82 disposed on the keeper and when the keeper is installed, it forces terminations of individual conductors of the flexible circuit against terminations of individual conductors on the carrier assembly leading to the solenoids. For this purpose the keeper may have inherent resiliency or it may carry resilient means. The individual conductors of the flexible circuit may be the terminations, or they may have attached terminals that form the terminations.

Figures 6, 7:
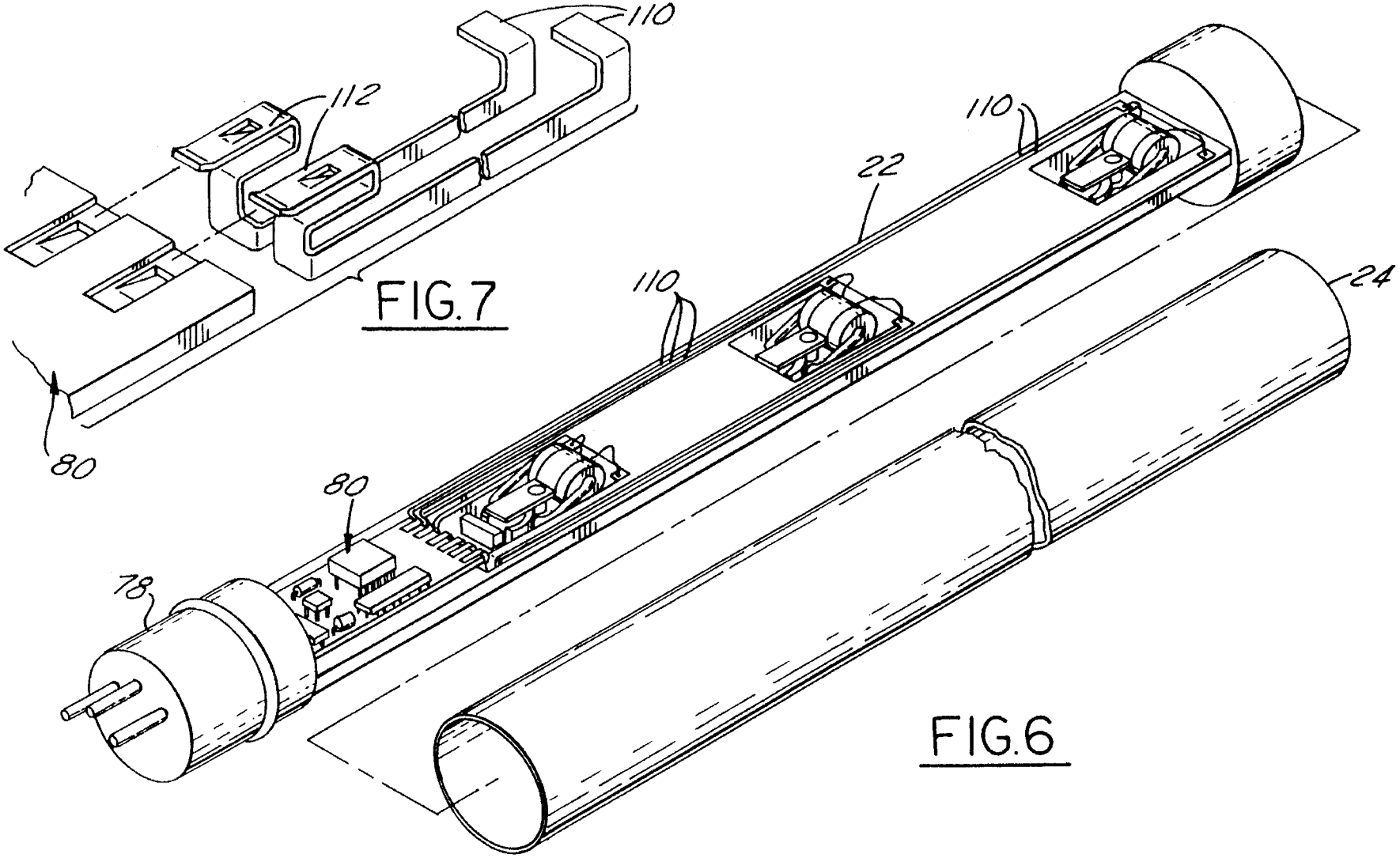
FIG. 6 is a perspective view, partly exploded, of a third embodiment of fuel rail assembly.
FIG. 7 is a fragmentary enlarged view of a portion of FIG. 6 further exploded.

The fuel rail assembly of FIGS. 6 and 7 does not use a flexible circuit; rather it has formed metal conductors 110 embedded or inlaid in channels of the carrier assembly. These conductors 110 have terminations 112 like those shown for separably engaging terminations of conductive paths on the board containing circuitry 80.

The disclosed embodiments are improvements that enhance the use of such fuel rail assemblies in one or more of the respects mentioned above.

What is claimed is:

1. A fuel rail assembly comprising a walled fuel tube within which is disposed a carrier containing a plurality of electrically operated fuel injectors at various locations along the carrier, an inlet through which fuel is supplied to said fuel tube, said fuel injectors having nozzles that are disposed in and peripherally sealed to through-holes in said wall for injecting fuel from the fuel rail assembly at various locations along the fuel rail assembly, an electrical connector that is accessible on the exterior of the fuel rail assembly to provide for connection of said fuel injectors to a source of control for operating said fuel injectors, and circuit means providing electrical connection of said fuel injectors to said electrical connector, said circuit means containing multiple, individual conductors.

2. A fuel rail assembly as set forth in claim 1 additionally including a keeper that is disposed within said fuel tube between said carrier and a second semi-circumference of said wall opposite the semi-circumference that contains said holes for keeping said fuel injectors' nozzles in said holes by preventing the carrier from being displaced toward said second semi circumference sufficiently to remove said fuel injectors' nozzles from said through-holes, and a portion of said circuit means being disposed on said keeper includes a flexible circuit containing multiple individual conductors.

3. A fuel rail assembly as set forth in claim 2 in which said keeper acts to force individual conductors of said flexible circuit into electrical contact with other conductors on said carrier that lead to said fuel injectors.

4. A fuel rail assembly as set forth in claim 1 wherein said circuit means comprises a flexible circuit having a transverse dimension that requires that it be folded along a line that is parallel to said fuel tube in order to fit inside said fuel tube.

5. A fuel rail assembly as set forth in claim 4 in which a margin of said flexible circuit that extends parallel to said fuel rail tube is folded so as to be disposed between said carrier and a semi-circumference of the wall of said fuel tube containing said through-holes.

6. A fuel rail assembly as set forth in claim 4 in which a margin of said flexible circuit that extends parallel to said fuel rail tube is folded so as to be disposed between said carrier and a semi-circumference of the wall of said fuel tube.

7. A fuel rail assembly as set forth in claim 6 in which said carrier contains a recess for receiving that portion of said flexible circuit that is disposed between said carrier and said semi-circumference.

8. A fuel rail assembly as set forth in claim 1 wherein said circuit means comprises an electronic circuit board assembly and conductors extending from said circuit board assembly to said fuel injectors, and wherein said circuit board assembly and said conductors comprise separably mated connections between them.

9. A fuel rail assembly as set forth in claim 8 in which said separably mated connections comprise an edge connector on said circuit board assembly.

* * * * *